US005257512A

United States Patent [19]

Febrer

[11] Patent Number: 5,257,512

[45] Date of Patent: Nov. 2, 1993

[54] FASTENER FOR NECKLACES, BRACELETS AND OTHER JEWELRY ARTICLES

[75] Inventor: Antonio A. Febrer, Manacor, Spain

[73] Assignee: Perlas Manacor S.A., Manacor, Spain

[21] Appl. No.: 926,845

[22] Filed: Aug. 6, 1992

Related U.S. Application Data

[63] Continuation of Ser. No. 667,586, Mar. 11, 1991, abandoned.

[30] Foreign Application Priority Data

Oct. 23, 1990 [ES] Spain ..... 9003037[U]

[51] Int. Cl.[5] ..... A44C 5/02

[52] U.S. Cl. ..... 63/4; 24/643

[58] Field of Search ..... 63/2, 3, 4; 24/643, 24/647, 662, 664

[56] References Cited

U.S. PATENT DOCUMENTS

| | | | |
|---|---|---|---|
| 408,308 | 8/1889 | Keller | 24/647 |
| 2,797,561 | 7/1957 | Vaughn | 63/13 |
| 2,896,288 | 7/1959 | Davis | 24/647 X |
| 4,411,050 | 10/1983 | Couture | 63/4 X |
| 4,425,687 | 1/1984 | Sauer | 63/12 X |
| 4,466,162 | 8/1984 | Pogharian et al. | 24/664 X |
| 4,535,514 | 8/1985 | Grabowski | 24/643 X |
| 4,562,625 | 1/1986 | Doty et al. | 24/643 |

FOREIGN PATENT DOCUMENTS

| | | | |
|---|---|---|---|
| 124183 | 3/1928 | Switzerland | 24/643 |

*Primary Examiner*—Peter M. Cuomo
*Assistant Examiner*—Jerry Redman
*Attorney, Agent, or Firm*—Michael J. Striker

[57] ABSTRACT

A fastener for jewelry articles includes a female component formed of two parts made of variable materials, having different shapes and dimensions, and defining an opening for receiving a male component, and a spring element for keeping the fastener in the closed condition thereof. The two parts are hingedly connected to each other. The female component further includes guides for guiding the male component in the opening, a retaining element for retaining the male component in the opening, and a ring secured to one of the two parts for attachment to an end of a jewelry article. The male component is a profiled plate having a hole cooperating with said retaining element to be held in the opening.

4 Claims, 1 Drawing Sheet

FASTENER FOR NECKLACES, BRACELETS AND OTHER JEWELRY ARTICLES

BACKGROUND OF THE INVENTION

This is a continuation of application Ser. No. 667,586 filed Mar. 11, 1991, now abandoned.

The present invention relates to fasteners for necklaces, bracelets, other jewelry, and costume jewelry articles, in particular, to fasteners comprising two (male and female) parts.

It is known to use tongue and slot fasteners for necklaces, bracelets, costume jewelry articles and the like. In known fasteners, the female component is rigid and is provided with a simple recess into which a male component is inserted and is retained. The male component is provided with elastic means that by reaction have to secure the mutual retaining. This fastener, unfortunately, is not always reliable, because the spring effect of the male component is lost with the use provoking unintentional disengagement of the fastener with all accompanying drawbacks.

SUMMARY OF THE INVENTION

The object of the invention is a fastener in which unintentional disengagement is reliably prevented. Another object of the invention is an interchangeable fastener adapted for use in different applications.

The object of the invention is achieved by providing a fastener in which the female component comprises two pieces of variable material, shape and dimensions, preferably of the same general outline, which are connected to each other by a hinge type articulation and are subject to a bias of an internal spring that, when at rest, keeps this fastener closed. Appearing in the internal face of these two pieces is means for receiving the male element, guiding it and automatic retaining. The male element is an appropriately profiled small plate. One of the two pieces of the female component is provided with a proper fastening ring to be attached to an end of a jewelry or costume jewelry article.

The present invention both as to its construction so to its method of operation, together with additional objects and advantages thereof, will be best understood from the following detailed description of the preferred embodiments when read with reference to the accompanying drawings.

DETAILED DESCRIPTION OF THE PREFERRED EMBODIMENTS

Figure 4:
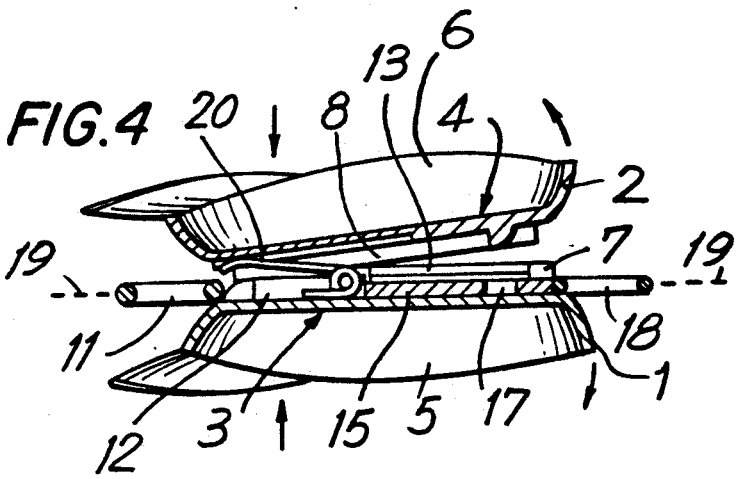
FIG. 4 is a cross-sectional view at a larger scale of the fastener according to the invention.

The fastener shown in the accompanying figures, comprises a female part or component consisting of two adjustable flat parts 1 and 2 having, preferably, the same outline and provided each with an external recess 3 and 4, respectively. A conveniently fixed ornamental motive 5 and 6, that can be a pearl, a fine stone or the like is inserted in each recess as shown in FIG. 4. Rear portions of the parts 1 and 2 are provided with identical wings 1' and 2' each extending rearwardly from an upper portion of each part and spaced from one another in a vertical direction.

Figure 2:
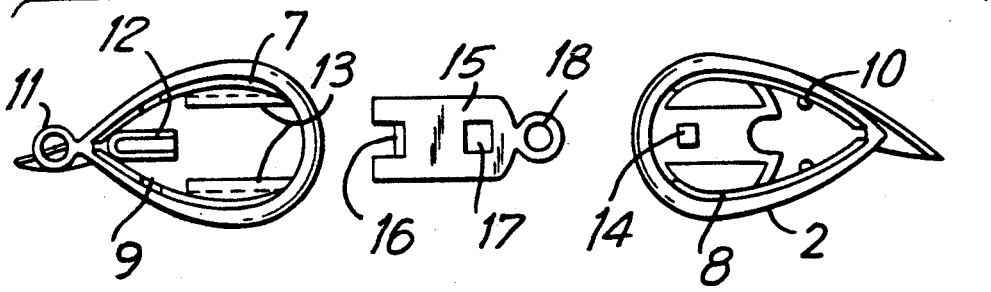
FIG. 2 is a plan view of the female component shown in FIG. 1 with a male component of the fastener added up.

On opposite side from the recess, the parts 1 and 2 have ribs 7 and 8, respectively, the part 1 being provided with holes 9 and the part 2 having internal pivots 10 as shown in FIG. 2, to form a hinge type articulation of the female parts. One of the parts 1 and 2, for example, the part 1 has an end ring 11. In the internal recessed face thereof which is opposite to the ornamental one above, there is a box 12 and lengthwise guides 13. The other part 2 is provided, also on its inside face, with a projection or stop 14 having a bent entry edge.

The male component or part is formed by a forked plate 15 with a beveled bottom recess 16, a hole 17 corresponding to the stop 14, and a ring 18, the same as the ring 11 which is to be fixed to an end of the necklace, bracelet or similar ends, shown with a dotted line 19.

Figure 1:
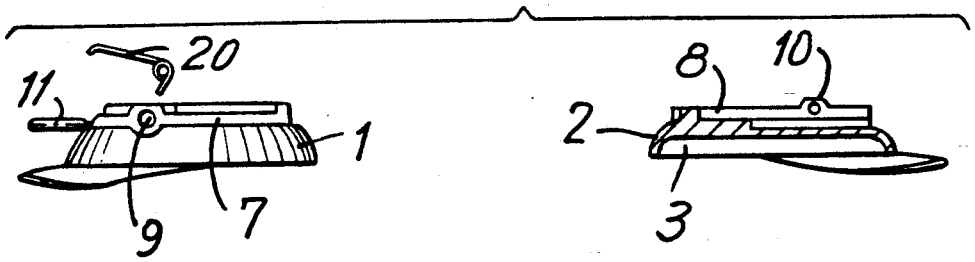
FIG. 1 is an exploded view of a female component of a fastener according to the present invention.
Figure 3:
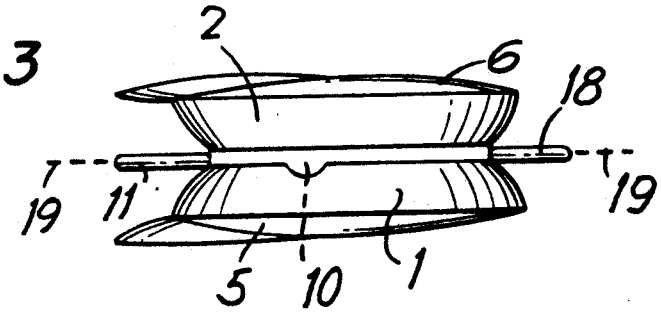
FIG. 3 is a side elevational view of a fastener according to the invention.

As elastic means to close and open this fastener, a single-wire spring 20 (FIG. 1) embedded within the box 12 (FIG. 4) and oriented in such a way that, in the rest position, it keeps the fastener shown in FIG. 3 under pressure, is used.

The operation of the above fastener can be summarized as follows: By the action of the spring 20, the device is kept closed by a lever effect because the expanding bias acts on the opposite part of the male element 15 entrance.

The insertion of the latter for fastening is simply carried out by introducing the plate 15 along the guide 13. The forward movement ends when the stop 14 acting as a retaining tooth engages in the hole 17 of the part 15. This provides for perfect fastening of the male and female parts of the fastener and reliably prevents unintentional opening of the fastener. Opening is effected by pressing the wings 1' and 2' toward one another and thereby manually moving the front portions of the parts 1 and 2 away from each other as shown by arrows in FIG. 4. This movement releases the bias of spring 20, and the male part 15 can easily be withdrawn.

While the invention has been illustrated and described as embodied in a jewelry fastener, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fastener for necklaces, bracelets, costume jewelry articles, comprising a female component; a male component received within said female component; and spring means for keeping said fastener in a closed condition thereof; said female component including two parts defining an opening for receiving said male component, means for hingedly connecting said two parts together, guide means for guiding said male component in said opening, means for retaining said male component in said opening, and a ring secured to one of said two parts for attachment to an end of a jewelry article; said male component comprising a profiled plate having means cooperating with said retaining means for said male component to be retained in said opening, and a ring for attachment to another end of the jewelry article, said two parts having inner surfaces which in assembled condition face toward one another and define said opening and have two opposite ends, said hingedly connecting means being provided in said two parts in the region of one of said ends, said parts having identical wings extending from said one end rearwardly and spaced from one another in a transverse direction, said retaining means including a toothed projection provided on said inner surface of said another of said two parts in the region of another of said ends, while said cooperating means comprises a hole formed in said profiled plate also in the region of said another end and receiving said toothed projection, so that when said wings are pressed by fingers of a user toward one another in the region of said one end of said parts said another ends of said parts move away from one another so as to release a bias of said spring means and thereby said toothed projection of said another of said two parts disengages from said hole of said profiled plate to enable withdrawal of said male component from said opening between said two parts.

2. A fastener as set forth in claim 1, wherein said inner surfaces defining said opening have ribs, said hingedly connecting means including holes formed in ribs of one of said two parts pivot provided on ribs of another of said two parts, said guide means being provided on said one of said two parts, and said tooth projection having a beveled edge to facilitate entry of said male component, said profiled plate comprising a forked plate having a chamfered recess cooperating with said beveled edge of said tooth projection to enable entry of said male component into said opening.

3. A fastener as set forth in claim 2, wherein the inner surface of said one of said two parts has an intermediate box at an end thereof remote from an entrance into said opening, and said spring means comprises a wire spring having one arm thereof located in said box and another arm thereof acting on the inner surface of said another of said two parts to keep said fastener in the closed condition thereof.

4. A fastener for necklaces, bracelets, costume jewelry articles, comprising a female component; a male component received within said female component; and spring means for keeping said fastener in a closed condition thereof; said female component including two parts defining an opening for receiving said male component, means for hingedly connecting said two parts together, guide means for guiding said male component in said opening, means for retaining said male component in said opening, and a ring secured to one of said two parts for attachment to an end of a jewelry article; said male component comprising a profiled plate having means cooperating with said retaining means for said male component to be retained in said opening, and a ring for attachment to another end of the jewelry article, said two parts having inner surfaces which in assembled condition face toward one another and define said opening and have two opposite ends, said hingedly connecting means being provided in said two parts in the region of one of said ends, said parts having identical wings extending from said one end rearwardly and spaced from one another in a transverse direction, said retaining means including a toothed projection provided on said inner surface of said another of said two parts in the region of another of said ends, while said cooperating means comprises a hole formed in said profiled plate also in the region of said another end and receiving said toothed projection, so that when said wings are pressed by fingers of a user toward one another in the region of said one end of said parts said another ends of said parts move away from one another so as to release a bias of said spring means and thereby said toothed projection of said another of said two parts disengages from said hole of said profiled plate to enable withdrawal of said male component from said opening between said two parts, said inner surfaces defining said opening have ribs, said hingedly connecting means including holes formed in ribs of one of said two parts pivot provided on ribs of another of said two parts, and tooth projection having a beveled edge to facilitate entry of said male component, said profiled plate comprising a forked plate having a chamfered recess cooperating with said beveled edge of said tooth projection to enable entry of said male component into said opening, the inner surface of said one of said two parts has an intermediate box at an end thereof remote from an entrance into said opening, and said spring means comprises a wire spring having one arm thereof located in said box and another arm thereof acting on the inner surface of said another of said two parts to keep said fastener in the closed condition thereof.

* * * * *